US007487758B1

(12) United States Patent
Reid

(10) Patent No.: US 7,487,758 B1
(45) Date of Patent: Feb. 10, 2009

(54) CONTROL APPARATUS FOR A THROTTLE STOP OF AN INTERNAL COMBUSTION ENGINE

(75) Inventor: Dennis Reid, Pleasant Hill, CA (US)

(73) Assignee: Dedenbear Products, Inc., Pleasant Hill, CA (US)

( * ) Notice: Subject to any disclaimer, the term of this patent is extended or adjusted under 35 U.S.C. 154(b) by 0 days.

(21) Appl. No.: 11/520,305

(22) Filed: Sep. 12, 2006

(51) Int. Cl.
*F02D 11/10* (2006.01)

(52) U.S. Cl. ..... 123/399; 123/337

(58) Field of Classification Search ..... 123/336, 123/337, 342, 361, 396, 399
See application file for complete search history.

(56) References Cited

U.S. PATENT DOCUMENTS

| | | | | | |
|---|---|---|---|---|---|
| 4,278,063 | A | | 7/1981 | Nakamura et al. | 123/432 |
| 4,381,747 | A | * | 5/1983 | Kobayashi et al. | 123/361 |
| 4,494,488 | A | | 1/1985 | Wheatley | 123/1 A |
| 4,592,322 | A | * | 6/1986 | Murakami et al. | 123/361 |
| 4,612,615 | A | * | 9/1986 | Murakami | 123/399 |
| 4,784,099 | A | | 11/1988 | Noe et al. | 123/398 |
| 4,796,594 | A | | 1/1989 | Duret | 123/531 |
| 4,971,586 | A | | 11/1990 | Walsh | 440/88 R |
| 5,002,028 | A | * | 3/1991 | Arai et al. | 123/399 |
| 5,003,948 | A | | 4/1991 | Churchill et al. | 123/352 |
| 5,235,948 | A | | 8/1993 | Grant et al. | 123/342 |
| 5,269,275 | A | | 12/1993 | Dahlgren | 123/492 |
| 5,396,869 | A | | 3/1995 | Suzuki et al. | 123/399 |
| 5,444,628 | A | | 8/1995 | Meaney et al. | 701/109 |
| 5,638,277 | A | | 6/1997 | Nagai | 701/70 |
| 5,642,712 | A | | 7/1997 | Biondo | 123/398 |
| 5,743,241 | A | | 4/1998 | Wood et al. | 123/531 |
| 5,778,856 | A | | 7/1998 | Okada et al. | 123/406.47 |
| 5,839,419 | A | | 11/1998 | Hawley | 123/398 |
| 5,967,099 | A | | 10/1999 | Patrick | 123/1 A |
| 6,006,724 | A | | 12/1999 | Takahashi et al. | 123/339.19 |
| 6,105,563 | A | | 8/2000 | Patrick | 123/585 |
| 6,166,629 | A | * | 12/2000 | Hamma et al. | 340/438 |
| 6,189,505 | B1 | | 2/2001 | Reid | 123/336 |
| 6,234,155 | B1 | | 5/2001 | Brothers et al. | 123/586 |
| 6,240,911 | B1 | | 6/2001 | Patrick | 123/585 |
| 6,260,546 | B1 | | 7/2001 | Vaughn | 123/585 |
| 6,349,709 | B1 | | 2/2002 | Evert et al. | 123/585 |
| 6,502,543 | B1 | | 1/2003 | Arai et al. | 123/348 |
| 6,523,530 | B2 | | 2/2003 | Evert et al. | 123/585 |
| 6,526,941 | B1 | | 3/2003 | McDonald et al. | 123/399 |
| 6,758,198 | B1 | | 7/2004 | Suhre et al. | 123/585 |
| 6,760,659 | B1 | | 7/2004 | Cowen | 701/113 |
| 6,837,228 | B2 | | 1/2005 | Baasch et al. | 123/585 |
| 2006/0042593 | A1 | | 3/2006 | Nakamoto et al. | 123/399 |
| 2006/0060168 | A1 | | 3/2006 | Watanabe et al. | 123/399 |

* cited by examiner

*Primary Examiner*—Stephen K Cronin
*Assistant Examiner*—Arnold Castro
(74) *Attorney, Agent, or Firm*—Weaver Austin Villeneuve & Sampson LLP

(57) ABSTRACT

The present invention relates to a control apparatus for a throttle stop. The control apparatus provides accurate and consistent throttle stop operation.

19 Claims, 7 Drawing Sheets

CONTROL APPARATUS FOR A THROTTLE STOP OF AN INTERNAL COMBUSTION ENGINE

BACKGROUND OF THE INVENTION

A drag race is a race between two racing vehicles (typically cars or motorcycles) from a standing start to a finish line that is up to a quarter mile away down a straight race track. A drag race is started by a vertical series of lights, called a "Christmas tree," that sequentially light yellow lights followed by a green light that starts the race. The objective of a drag race is to reach the finish line in less time, after the green light starts the race, than does the opponent. The time to reach the finish line is the total of two parts of the race: the length of time between the green light signaling that the race has started and the vehicle leaving the starting line (commonly referred to as the Reaction Time), and the time between leaving the starting line to reaching the finish line (commonly referred to as the Elapsed Time or ET). Electronic timers measure both the Reaction Time and ET.

Some types of drag racing limit the cars to a selected ET. In those races, examples of which are referred to as "Bracket Racing" or "Super Class Racing", the driver, the race track, or the race sanctioning association selects the ET that the car should run. This is known in racing as the Dial In. The object of a drag race in which the cars each have a Dial In is for the car to reach the finish line ahead of the opponent and do so with an ET that is equal to or larger than the Dial In. If the racer goes quicker than his Dial In and his opponent does not, then his opponent wins the race. If both racers go quicker than their Dial Ins, the racer who goes furthest under his Dial In is disqualified and his opponent wins.

In Super Class racing, both cars are assigned the same Dial In and therefore, both cars leave the starting line at the same time. They race each other and try to finish first without going quicker than the assigned Dial In.

In other ET or Bracket racing, a slow car can race a fast car by having the race track handicap the fast car by permitting the slower car to start the race first. This is done using a Christmas Tree that has a series of lights for each car. The Christmas Tree lights for the slower car are lighted a selected amount of time before the lights for the faster car. Handicapping allows the slower car to start first by an amount of time that is equal to the difference between the Dial Ins of the two cars (the handicap). In theory, if both cars leave the starting line exactly when their respective green Christmas tree lights turn on, and they run perfectly on their Dial In, they should cross the finish line at the same time.

The purpose of this type of racing is to minimize the cost of campaigning a race car. A car that competes in Super Class or ET racing need not be at its performance limit to compete. Cars are built to reliably perform well enough to complete the race at the Dial In. In the Super Classes, where the Dial In is assigned by the track or the race sanctioning body, and in other ET racing, the race car engines produce enough power so that the car can run quicker than the Dial In under track or weather conditions that cause a car to run slower than normal. A car having more power than required to run its Dial In can always run too quickly under normal conditions and so it must be slowed down to avoid disqualification for running under its Dial In.

Devices known as "throttle stops" were created to selectively limit the power of race car engines to prevent the car from completing the race with an ET that is less than its Dial In. A throttle stop adjustably controls the engine throttle to set the engine power level up or down to allow the car to run at exactly the Dial In regardless of the track or weather conditions. An additional benefit of using a throttle stop is that it can be turned on and off (changed from limited or throttle stopped power to full power) as the car goes down the track. This usually results in a car having a higher speed at the end of the track than would normally be expected for a car that runs the selected Dial In. This is a particular advantage for a faster car that is chasing a slower car because the faster car driver can judge both how fast he is closing in on the slower car and when he will cross the finish line, and can decide whether to release a throttle stop to increase the car's speed. The slower car driver must continually look over his shoulder to see the faster car coming up behind him and then he must turn around to look at the finish line. These advantages of "throttle stops" have made them widely used and well known.

There are various types of throttle stops, including a "linkage style" throttle stop and a "baseplate style" throttle stop.

A linkage style throttle stop (see, for example, Dedenbear Products, Inc. catalog, volume 9, page 19 model TS-10) includes a collapsible link that is part of the throttle linkage between the gas pedal and the engine's fuel metering device (carburetor or fuel injector). The length of the collapsible link changes thereby changing the position of the butterflies on the fuel metering device to either a more closed position to limit the amount of air flow and engine power or to a more open position to increase engine power. This style throttle stop is inexpensive and easily adaptable to many types of fuel metering devices. A disadvantage of the linkage style throttle stop is that most racing fuel metering devices do not perform well under partial throttle conditions and therefore the car's performance becomes erratic.

Another type of throttle stop is the baseplate style. In this throttle stop, a baseplate is mounted under the fuel metering device. The baseplate has openings through which air and fuel from the fuel metering device enter the engine. Conventional baseplate throttle stops have a set of butterflies mounted in the baseplate openings. The baseplate butterflies open and close to control the total air/fuel mixture flow into the engine after the fuel has been injected into the airstream by the fuel metering device. The advantage of this type of throttle stop is that at all times during a race, the fuel metering device runs at its optimum condition of its wide open position so that the fuel metering and therefore the car performance stays very consistent. This style of throttle stop was created in 1987 by Dedenbear Products, Inc. and has been used to win many World drag racing championships (see Dedenbear Products, Inc. catalog, volume 9, pages 16-17 models TS-1 and TS-5).

An improvement of baseplate style throttle stops that is best described as a "disc" style stop is disclosed by U.S. Pat. No. 6,189,505, which is incorporated herein by reference. This throttle stop has, in one embodiment, two counter rotating discs that are stacked on top of each other. Each disc has holes that match the bores of a fuel metering device. As the discs are rotated toward the closed condition, the holes start to overlap and block each other, which chokes off the air/fuel flow. Rotating the discs to the fully open position results in substantially perfect open bores (holes) that match the fuel metering device bores. In this position, there is substantially no restriction to air/fuel flow so maximum engine horsepower is achieved.

All types of throttle stops require an actuator to activate the throttle stop mechanism. Actuators have typically been an electric solenoid or a pneumatic cylinder that move the throttle stop mechanisms.

Electric solenoids are desirable because they are very simple, reliable, and inexpensive. The drawback to using an electric solenoid is that it opens and shuts instantaneously. On a car with a high horsepower engine, opening and shutting the throttle stop quickly can often cause the car's rear drive tires to spin (lose traction) due to the abrupt change in the engine power level and driving becomes dangerous.

Because of this problem, pneumatic actuators are often used. Adjustable flow limiters in the air supply lines to a pneumatic actuator regulate the speed that the pneumatic actuator moves and therefore how fast the throttle stop opens and closes. By setting the speed that the stop opens and closes, a smooth transition from full power to limited power and vice versa results and the car remains stable as it goes down the track.

A disadvantage of both pneumatic and solenoid actuators is that they tend to open and close at the same speed for their entire stroke. For solenoids that speed is undesirably fast. For pneumatic actuators that speed is not always the same for different strokes, as the rate of actuation can change due to supply pressure or temperature variation.

SUMMARY

In one aspect, the invention features a throttle stop comprising a throttle stop element configured and arranged to be movable between a full open position and at least one flow restricting position to regulate the power of an engine by controlling the flow rate from an air-fuel metering device to the engine. The throttle stop includes an electric motor mounted to the throttle stop element. The motor is configured to move the throttle stop element a characteristic amount upon receiving an electrical signal in a direction that is determined by the electrical signal such that the throttle stop element is moveable between the full open position and the at least one flow restricting position.

Various implementations of the invention may include one or more of the following features. The throttle stop includes a feedback mechanism configured to determine the position of the throttle stop element. The feedback mechanism is an encoder, a linear potentiometer, or a linear variable displacement transducer. The electric motor is a stepper motor. A programmable controller is configured to control the operation of the electric motor. An open switch is configured to provide an indication that the throttle stop element is at the full open position. The throttle stop element is a throttle linkage member, a set of butterflies, or counter rotating discs.

In another aspect, the invention features a controllable throttle stop. The controllable throttle stop includes a mounting section constructed to engage a throttle linkage element. An electric motor is mounted to the mounting section. The motor is configured to move upon receiving an electrical signal in a direction that is determined by the electrical signal. An extendable link extends away from the motor. The motor is coupled to the extendable link to move the extendable link away from the mounting section in one direction and to move the extendable link toward the mounting section in another direction whereby the motor lengthens and shortens the throttle stop.

Various implementations of the invention may include one or more of the following features. The electric motor is a stepper motor. The stepper motor is configured to rotate in two opposite rotational directions and to rotate at characteristic amount upon receiving an electrical pulse. The stepper motor is configured to move the extendable link away from the mounting section upon rotation of the stepper motor in one rotational direction and to move the extendable link toward the mounting section upon rotation of the stepper motor in the other rotational direction. The extendable link is threaded at an end and the stepper motor includes a collar that engages the threaded end to move along the threaded end as the collar is rotated. A controller is operatively connected to the stepper motor. The controller is configured to provide electrical pulses to the stepper motor to cause the stepper motor to rotate. The controller is programmable to cause the stepper motor to cause the extendable link to move a selected distance. The controller is programmable to provide pulses to the stepper motor at a selected rate to specify the length of time during which the extendable link moves. A feedback mechanism is configured to determine the position of the extendable link.

In yet another aspect, the invention is directed to a controllable throttle stop including a base plate. The base plate is constructed to be mounted between a fuel metering device and an intake manifold of an internal combustion engine. The base plate has passages through which air and fuel flow from the fuel metering device into the internal combustion engine. The throttle plates are movably mounted to the base plate to selectively interfere with flow through the passages. A throttle plate mechanism is configured to engage the throttle plates to selectively move the throttle plates between a closed position that interferes with flow through the passages and an open position that permits at least substantially unimpeded flow through the passages. An electrical motor driven actuator is operatively coupled to the throttle plate mechanism to move the throttle plates to a more open position in one direction and to a more closed position in another direction to thereby selectively position the throttle plates.

Various implementations of the invention may include one or more of the following features. The actuator is a stepper motor coupled to the throttle plate mechanism. The stepper motor is configured to rotate in two opposite rotational directions and to rotate a characteristic amount upon receiving an electrical pulse. The stepper motor is coupled to the throttle plate mechanism to move the throttle plates to a more open position upon rotation of the stepper motor in one rotational direction and to move the throttle plates to a more closed position upon rotation of the stepper motor in the other rotational direction. A controller is operatively connected to the stepper motor. The controller is configured to provide electrical pulses to the stepper motor to cause the stepper motor to rotate to move the throttle plates a selected amount. The throttle plates are butterflies or counter rotating disks mounted in the passages. A feedback mechanism is configured to determine the position of the throttle plates.

In still another aspect, the invention is directed to a throttle stop apparatus to regulate the power of an internal combustion engine. The throttle stop apparatus includes a body mounted in the flow path between an air-ftiel metering device and intake valves of the engine. At least a first plate and a second plate are located within the body. The first and second plates are moveable between a full open position and at least one flow restricting position to selectively regulate the power of the engine by controlling flow from the air-fuel metering device to the intake valves of the engine. Each of the first and second plates have an opening with a configuration and dimension sufficient to create substantially no restriction to the flow in the full open position. An electric motor driven actuator is coupled to the first and second plates to move at least one plate relative to another to provide full alignment of the openings in the full open position at wide open throttle conditions of the engine and to provide at least partial restriction to the flow at the at least one flow restricting position.

The invention can include one or more of the following advantages. It provides a significant improvement in consistency and accuracy of throttle stop actuation. It enables a throttle stop to open or close a precise known amount, with various adjustments being possible. An electronic control module may be used for automatic positioning. A microprocessor control module may be programmed to control movement time, rate of actuator change, and direction (open and close). A control module may also have feedback capabilities to monitor a variety of data, such as engine revolutions per minute (rpm), weather conditions, engine exhaust temperatures, and engine loads.

The details of one or more embodiments are set forth in the accompanying drawings and the description below. Other features, objects and advantages will be apparent from the description and drawings, and from the claims.

DETAILED DESCRIPTION OF THE INVENTION

Figure 1:
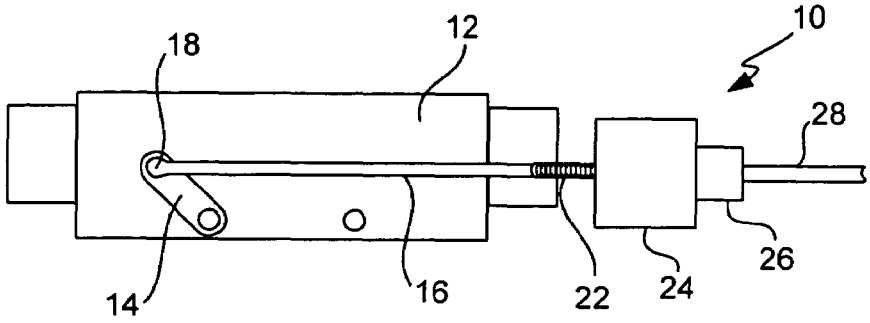
FIG. 1 is a schematic side view of a linkage-type throttle stop actuator according to the present invention.

FIG. 1 shows a throttle stop 10 according to the present invention that controls the opening of a fuel metering device 12. The fuel metering device 12 is a conventional fuel metering device, such as a carburetor or fuel injector throttle body, having conventional throttle butterflies (not shown). The fuel metering device 12 has a throttle lever or arm 14 that operates the throttle butterflies. A throttle linkage member 16 engages the throttle arm 14 at an end 18 of the throttle linkage member 16. A threaded section 22 is at an end of the throttle linkage member 16 opposite the end 18. The throttle stop 10 has a mounting section 26 that engages a throttle rod 28 to mount a stepper motor 24 to the throttle rod 28. The throttle rod 28 is part of a throttle control mechanism that moves in response to a driver's actuation of a throttle control, typically a pedal. The throttle rod 28 moves toward and away from the throttle lever 14 to move the throttle lever 14. Those skilled in the art will recognize that mechanical elements other than a rod, such as a cable, will function as does throttle rod 28.

Movement of the throttle rod 28 is transferred to the throttle lever 14 by movement of the linkage style throttle stop 10 and the throttle linkage member 16. The throttle stop 10 engages the threaded section 22 of the throttle linkage member 16. Specifically, the stepper motor 24 is coupled to and rotates a collar (not shown) that engages the threaded section 22 of the throttle linkage member 16. The collar may be part of a rotor of the stepper motor, or it may be a separate part that is attached to the rotor. Rotating the stepper motor collar that engages the threaded section 22 causes the collar to move along the threaded section 22 thereby moving the stepper motor 24 and mounting section 26 along the throttle linkage member 16.

A stepper motor is a type of an electrical motor that has magnets and coils arranged in such a way that when a direction signal and an electrical pulse are applied to the motor, from a stepper motor controller, the motor collar rotates a precise amount in a given direction. Specifically, each time a pulse is applied to the coil windings, the stepper motor collar rotates a precise angular amount, typically in the range of 1.8 to 7.5 degrees. For example, if a 7.5 degree stepper motor is pulsed 10 times, the motor rotor will rotate exactly 75 degrees. Thus, the throttle stop will open or close a precise known amount for each step pulse that the stepper motor receives.

The stepper motor is driven at a rate that is set by the stepper motor controller. The higher the rate, the faster the throttle stop opens. A time setting at which the throttle stop starts and stops is an optional feature. The controller is most typically started when it receives a trigger signal, most typically, a signal from the transmission brake or line lock. Such devices are used to hold a drag race vehicle on the starting line, and when they are released, the vehicle takes off. This is a conventional trigger point.

Rotating the stepper motor collar that engages the threaded section 22 causes the member to move along the threaded section thereby moving the stepper motor 24 and mounting section 26 along the throttle linkage member 16. The collar, as noted, rotates an amount that is characteristic of the motor in response to a pulse and rotates in a rotational direction that is determined by the pulse the stepper motor 24 receives. Rotation of the collar in one direction moves the stepper motor 24 and the mounting section 26 toward the throttle linkage member 16 shortening the throttle stop 10. Rotation of the collar in the opposite rotational direction moves the stepper motor 24 and the mounting section 26 away from the throttle linkage member 16 lengthening the throttle stop 10.

The throttle stop 10 lengthens (expands) and shortens (contracts) the section of throttle linkage consisting of the throttle linkage member 16 and the motor 24 that is mounted between and connected to, as described above, the throttle rod 28 and the throttle arm 14. When the throttle rod 28 is at a position, as for example at the farthest extension to open the throttle butterflies of the fuel metering device 12, operation of the throttle stop 10 will cause the throttle linkage member 16 to move toward the throttle rod 28 opening the throttle butterflies of the fuel metering device 12. Operation of the stepper motor 24 of the throttle stop 10 causes the throttle linkage member 16 to move either toward or away from the throttle rod 28 thereby opening or closing the throttle butterflies of the fuel metering device 12.

Figure 2:
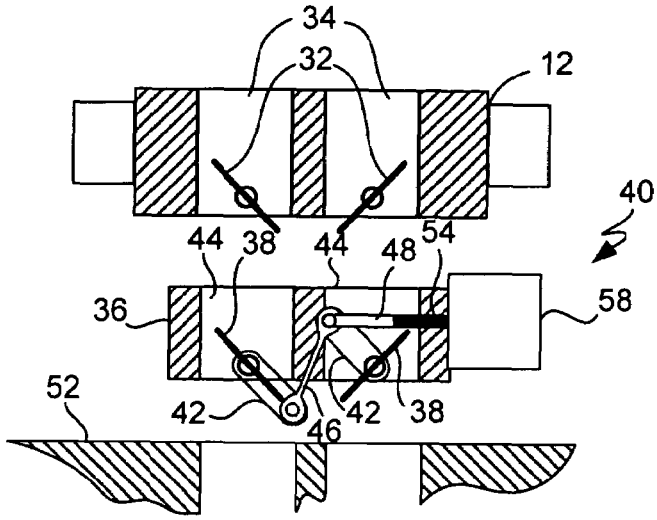
FIG. 2 is a partial cutaway schematic side view of a throttle stop actuator according to the present invention for a butterfly-type baseplate throttle stop.

FIG. 2 shows the fuel metering device 12 and a baseplate style throttle stop 40 according to the present invention. The fuel metering device 12 has butterflies 32 positioned in bores or passages 34 of the fuel metering device. The butterflies 32 are sized and configured to substantially block the passages 34. The butterflies 32 rotate within the passages 34 from a closed position in which they at least substantially obstruct passage of air through the passages 34 to an open position in which they are aligned with the passages 34 to minimally obstruct air passing through the passages 34. As shown by FIG. 2, the butterflies 32 are at a position between the open and closed positions of the metering device 12. The butterflies 32 are operated by a throttle control that such as a linkage or cable (not shown). A baseplate 36 is positioned between the fuel metering device 12 and an intake manifold 52. The baseplate 36 defines passages 44 that are sized and located to align with the passages 34 of the fuel metering device 12. Butterflies 38 of the throttle stop are sized and configured to substantially conform to the passages 44. The butterflies 38 are mounted in the passages 44 and rotate from an open position to a closed position as do butterflies 32 of the fuel metering device 12.

A butterfly arm 42 is connected to and extends from each butterfly 38. A butterfly link 46 is rotatably connected at each of two ends to respective ones of the butterfly arms 42 at a location on the butterfly arm 42 that is separated from the butterfly 38. The butterfly arms 42 and the butterfly link 46 form a mechanism that causes the butterflies 38 to move together from closed to open positions. A rod 48 is connected to a butterfly arm 42, as shown, at the location that the butterfly link 46 is rotatably attached to the butterfly arm 42. The rod 48 extends from the butterfly arm 42 to a threaded end 54. The threaded end 54 defines threads that extend along the rod 48. A stepper motor drive 58 engages the threaded end 54 of the rod 48. The stepper motor 58 draws the rod 48 toward the stepper motor 58 when the stepper motor 58 rotates in a first rotational direction, and extends the rod 48 from the stepper motor 58 when operated to rotate in a second rotational direction that is opposite to the first rotational direction. By drawing in and extending the rod 48, the stepper motor 58 rotates the butterflies 38 to any position between open and closed in the passages 44 of the baseplate 34.

Figure 3:
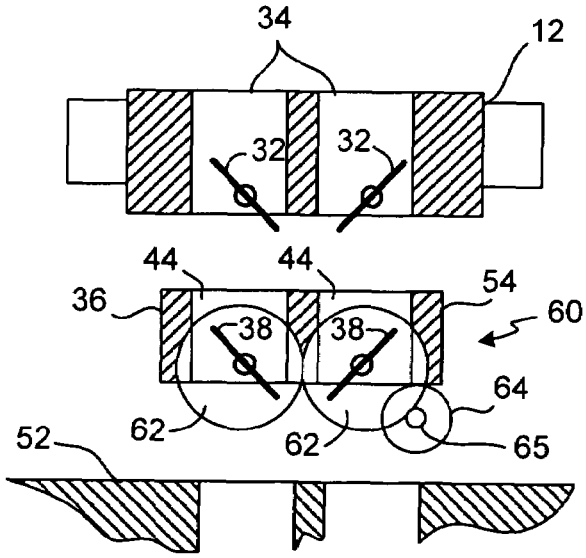
FIG. 3 is a partial cutaway schematic side view of another throttle stop actuator according to the present invention for a butterfly-type baseplate throttle stop.

FIG. 3 shows the fuel metering device 12 and another baseplate style throttle stop 60 according to the present invention. The fuel metering device 12 is as described above by reference to FIG. 2. The throttle stop 60 includes a baseplate 36 having passages 44 and butterflies 38 as previously described. The throttle stop 60 includes two gears 62, one attached to each butterfly 38 to rotate with the butterflies. The gears 62 are sized and positioned to mesh with each other so that both gears 62 and both butterflies 38 rotate. A stepper motor 64 drives a gear 65 that engages one of the gears 62. The stepper motor 64 rotates in a first rotational direction to rotate the gears 62 and butterflies 38 to a more open position within the passages 44. The stepper motor 64 rotates in a second rotational direction that is opposite to the first rotational direction to rotate the gears 62 and the butterflies 38 to a more closed position. Causing to the stepper motor 64 to rotate in a selected direction and a selected amount moves the butterflies to a selected position within the passages 44.

Figure 4:
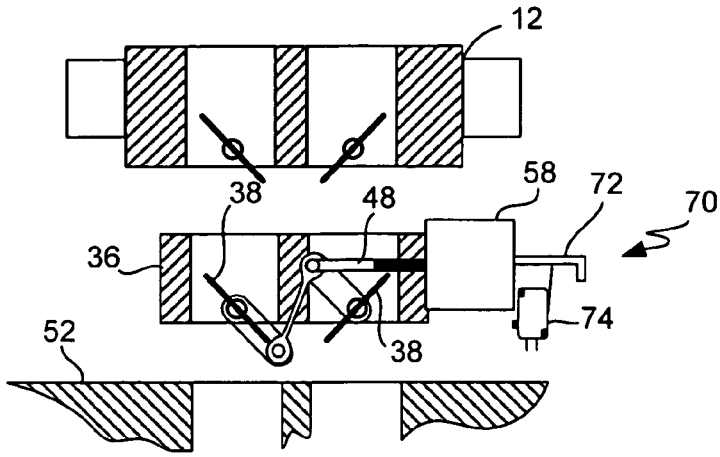
FIG. 4 is a partial cutaway schematic side view of the throttle stop actuator as shown by FIG. 2 with linkage position indicating apparatus.

FIG. 4 shows a fuel metering device 12 and a baseplate style throttle stop 70 according to the present invention. The throttle stop 70 is distinguished from throttle stop 40 of FIG. 2 by the addition of a rod 72 extending from the stepper motor 58 and an open switch 74. The rod 72 moves with the rod 48 that opens and closes the butterflies 38 so that the position of the rod 72 indicates the position of the butterflies 38. The rod 72 is configured to contact and close the switch 74 when the butterflies 38 are at the full open position. The switch 74 thus provides an indication that the butterflies are at their wide open position.

The switch 74 further insures the accuracy of a throttle stop opening. Occasionally, a stepper motor may get stuck and not rotate even though it is receiving stepping pulses from a controller. Also, if the power is interrupted to the controller in the middle of a cycle, the controller can lose track of the position of the throttle stop. Although these problems are rare, by adding the switch 74, any potential problems are minimized. When the power is first turned on, the controller runs the throttle stop to its wide open position at which point the rod 72 contains the switch 74. The switch 74 then sends a signal to the controller to indicate that the full stroke or wide open position has been achieved. The controller can then reset its internal counters to the open position. The controller could then reposition the throttle stop at its preset starting position. Each time the throttle stop reaches full open, the counters can be reset. Additionally, a manual calibration switch can be used such that when a racer presses the recalibration switch, the controller causes the throttle stop to move to its fully open position, thereby receiving an open position calibration signal.

Figure 5:
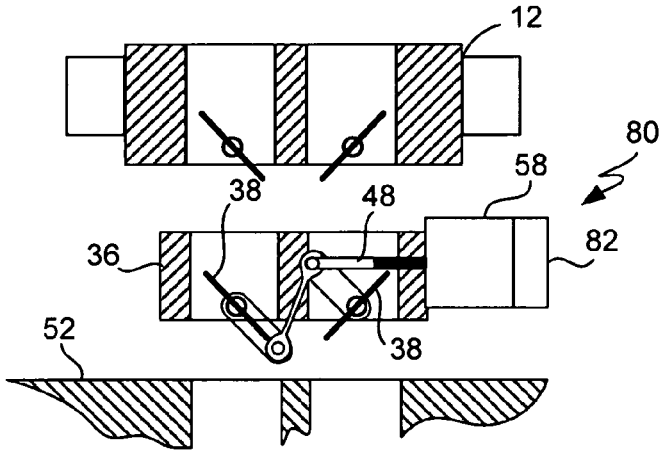
FIG. 5 is a partial cutaway schematic side view of the throttle stop actuator as shown by FIG. 2 with a position indicating encoder.

FIG. 5 shows a fuel metering device 12 and a baseplate style throttle stop 80 according to the present invention. The throttle stop 80 is distinguished from throttle stop 40 of FIG. 2 by the addition of an encoder 82 to the stepper motor 58. The encoder 82 monitors movement of the stepper motor 58 and provides an indication of the position of the motor and thereby the rod 48 and the butterflies 38. That is, the encoder 82 provides feedback information to the stepper motor controller as to the absolute (actual) position of the rod 48 and the butterflies 38. As such, the encoder provides throttle stop position information.

Figure 6:
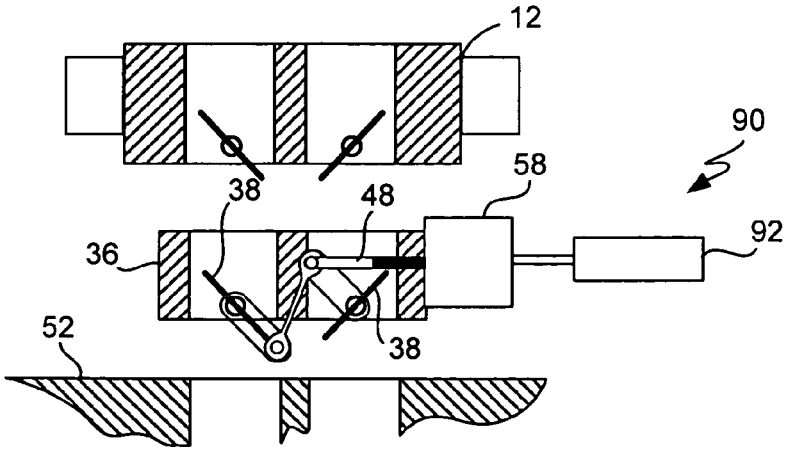
FIG. 6 is a partial cutaway schematic side view of the throttle stop actuator as shown by FIG. 2 with a linear position indicating device.

FIG. 6 shows a fuel metering device 12 and a baseplate style throttle stop 90 according to the present invention. The throttle stop 90 is distinguished from throttle stop 40 of FIG. 2 by the addition of a linear position indicating device 92 mounted to the stepper motor 58. The linear position indicating device 92 may be a linear potentiometer or linear variable displacement transducer (LVDT) that engages the rod 48, directly or through intermediate members, to indicate linear movement of the rod 48. Like the encoder 82, the linear position indicating device 92 provides feedback information to ensure the accurate positioning of the throttle stop.

Figure 7A:
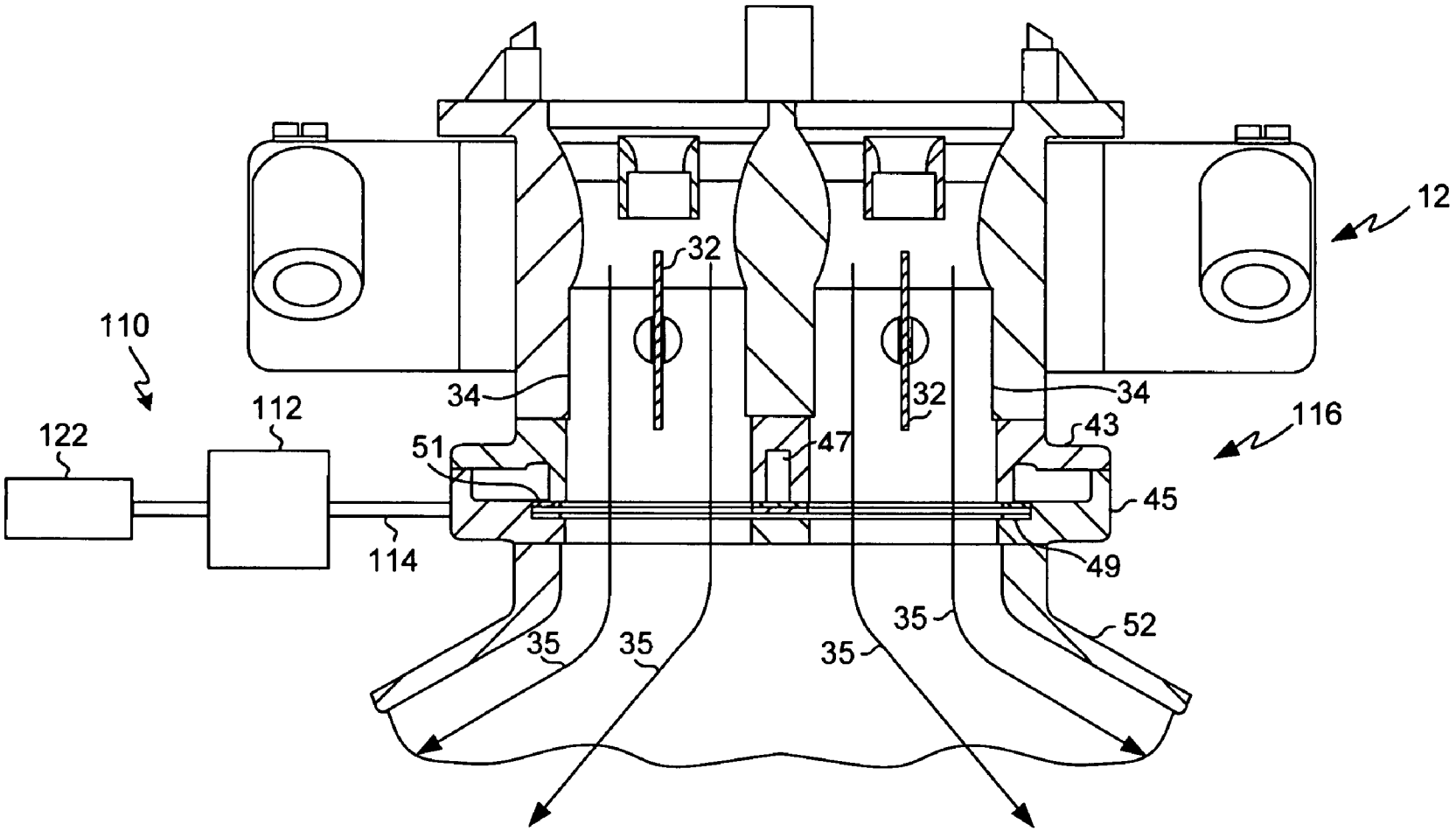
FIG. 7A is a schematic side elevation view of a linear throttle stop actuator for a disc style throttle stop according to the present invention.
Figure 7B:
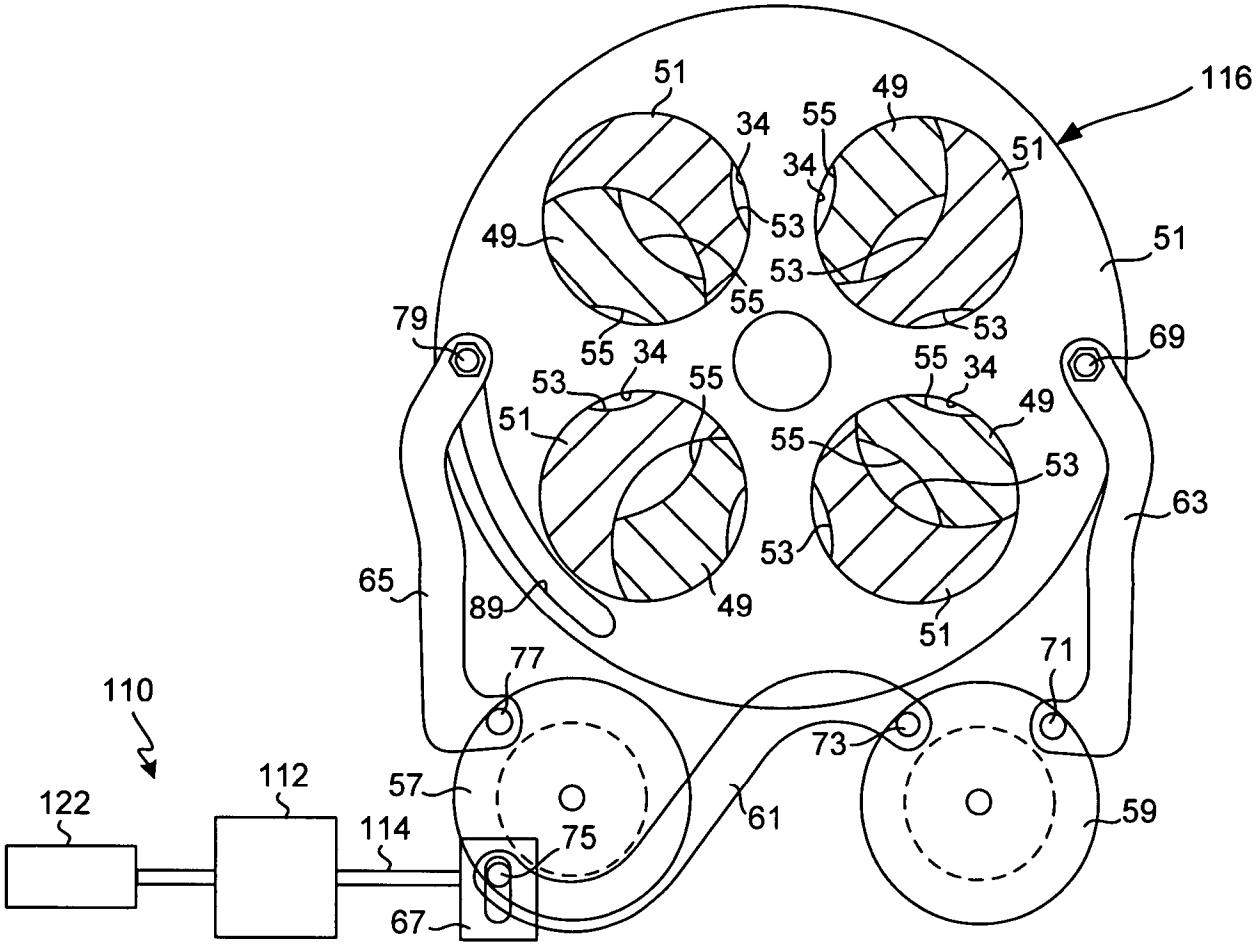
FIG. 7B is a schematic top view of the linear throttle stop actuator for the disc style throttle stop.

FIGS. 7A and 7B show a disc style throttle stop 116, as described in the above-mentioned U.S. Pat. No. 6,189,505, having a throttle stop actuator 110 mounted to the throttle stop 116. The actuator 110 includes a stepper motor 112, a rod 114, and a linear position indicating device 122.

The throttle stop 116 shown in FIG. 7A is mounted beneath a fuel control or metering 12 such as a carburetor. The throttle stop comprises a body having a top half 43 and a bottom half 45. This body contains the moving parts. The two halves 43 and 45 of the body are bolted together, and the unit is mounted and sealed with gaskets between an intake manifold 52 and the fuel metering device 12.

Two flow control discs 49 (bottom) and 51 (top) are mounted inside the lower body half 45. The flow control discs are mounted one above the other. The bottom half 45 has a center pin 47. The bottom flow control disc 49 and the top flow control disc 51 are each mounted for rotation about the center pin 47. The top flow control disc 51 has holes 53 machined into it that correspond to the bores 34 of the fuel control device 12. The bottom flow control disc 49 has holes 55 machined into it that also correspond to the bores 34 of the fuel metering device.

In the fully opened position of the throttle stop 116, the holes 53 and 55 are both aligned with one another and with the related bores 34 of the fuel metering device 12. In this fully opened position, the holes 53 and 55 provide perfectly open bores that match the fuel metering device bores. In this position, there is substantially no restriction to air/fuel flow, so maximum engine horsepower is achieved. The pattern of air/fuel flow, as shown by the path lines 35, is a straight through uninterrupted and undeflected path.

In the fully closed position of the throttle stop 116, shown in FIG. 7B, the top flow control disc 51 has been rotated counterclockwise about the pin 47 and the bottom flow control disc 49 has been rotated clockwise about the pin 47. The fully closed position produces the minimum area of the openings for fuel/air flow. The super imposed, four outlined circles show the fixed, unchangeable locations of the four circular bores 34 of the fuel metering device 12.

The mechanisms for rotating the flow control discs 49 and 51 back and forth between the fully opened position and the fully closed position comprise, as shown in FIG. 7B, a drive linkage disc 57, a slave linkage (or driven) disc 59, an interconnect link 61, link bars 63 and 65, a scotch yoke block 67, and pins 69, 71, 73, 75, 77 and 79. The two link bars 63 and 65 connect the flow control discs 49 and 51 to the drive linkage disc 57 and the slave linkage disc 59. The interconnect link 61 cross connects the drive linkage disc 57 and the slave linkage disc 59. The drive linkage disc 57 is rotated by means of the scotch yoke block 67 which is attached to the end of the rod 114 of the throttle stop actuator 110.

The linear position indicating device 122 may be a linear potentiometer or an LVDT. The position indicating device 122 indicates the position of the discs of the throttle stop 116.

Figure 8:
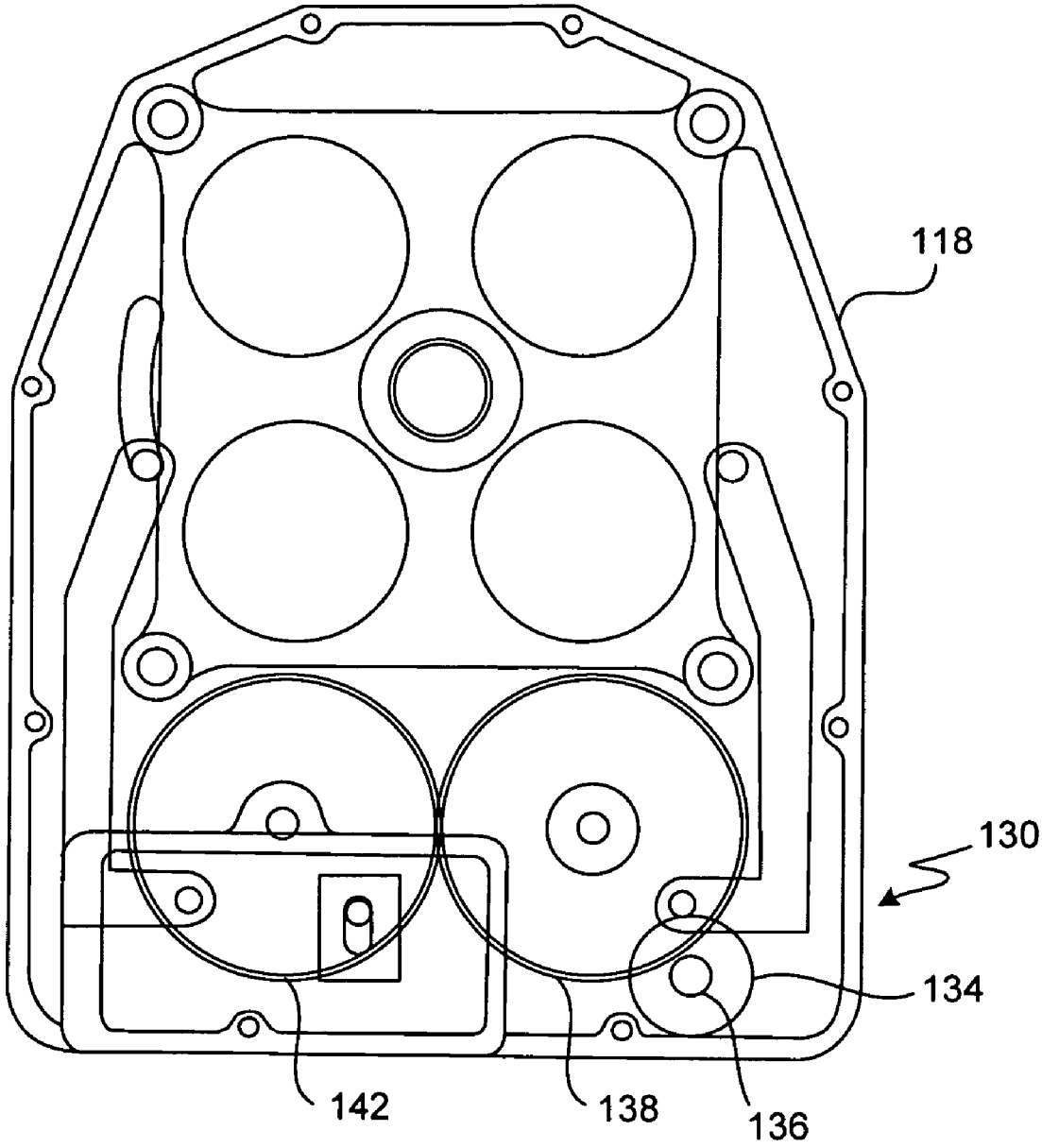
FIG. 8 is a schematic top view of a gear driven throttle stop actuator and disc style throttle stop according to the present invention.

FIG. 8 shows a disc-type throttle stop 118, as described in U.S. Pat. No. 6,189,505, having a throttle stop actuator 130 according to the present invention. The throttle stop 118 does not use linkage discs and connecting links. Instead, the drive linkages comprise rotating gears 138 and 142, and the linkage discs are replaced with meshing of the gears 138 and 142 that eliminate the interconnect link 61. The gears 138 and 142 are mounted to drive the flow control discs 49 and 51 (see FIGS. 7A and 7B).

The throttle stop actuator 130 includes a stepper motor 134 that drives a pinion gear 136. The stepper motor 134 is positioned so that the pinion gear 136 engages the gear 138. The stepper motor 134 thereby positions the flow control discs of the throttle stop 116 by drivingly rotating the pinion gear 134 to drive the gears 138 and 142.

Figure 9:
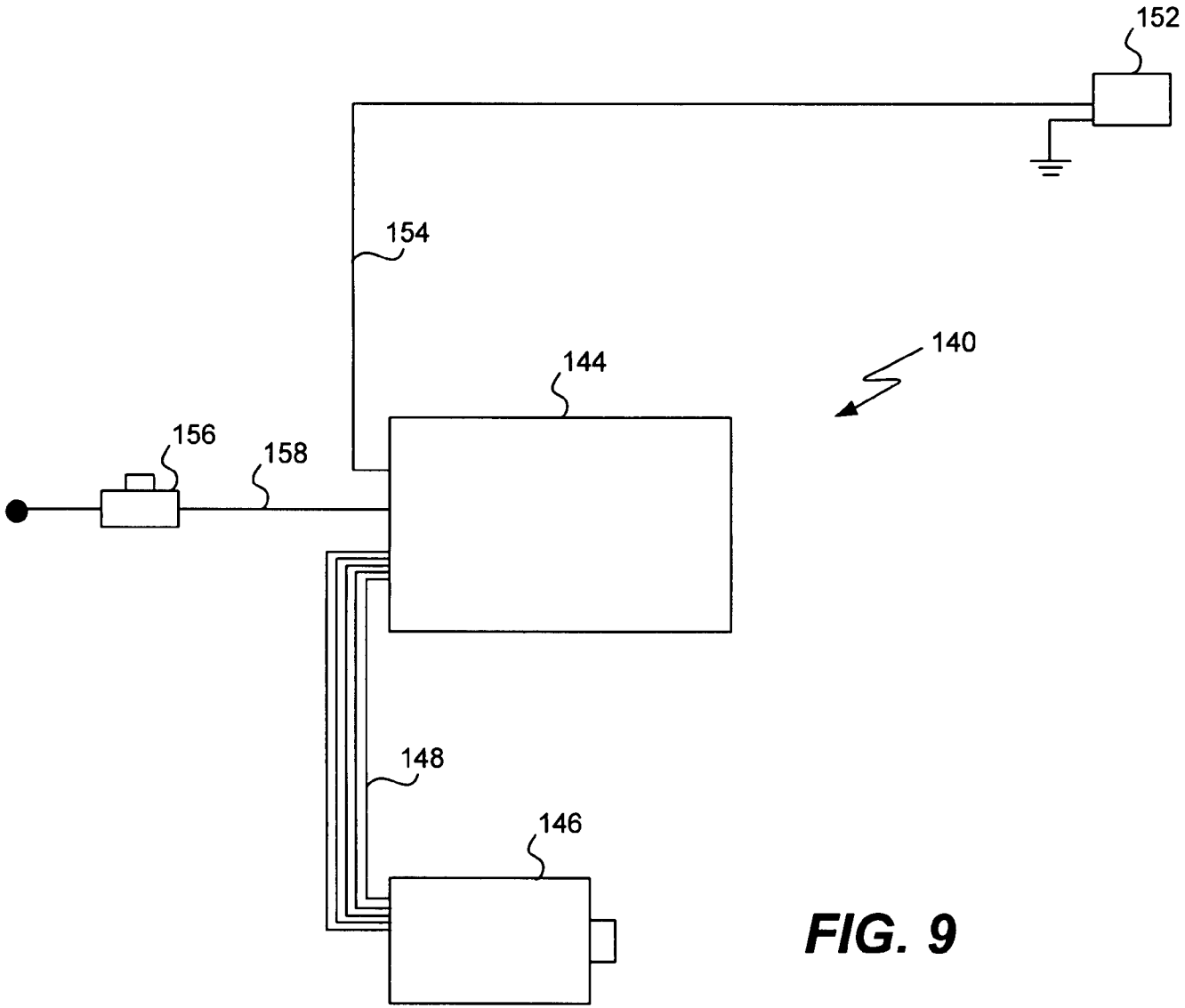
FIG. 9 is a schematic diagram of a control system for a throttle stop actuator according to the present invention.

FIG. 9 shows a control system 140 for a throttle stop or throttle stop actuator according to the present invention. The control system includes a controller or control module 144 connected to a stepper motor 146 that is a component of a throttle stop according to the present invention. A line 148 provides signals and power to the stepper motor 146 to cause the stepper motor 146 to rotate a characteristic amount or step. The controller 144 provides a number of pulses to the stepper motor 146 to cause the stepper motor to rotate an amount that will cause the throttle stop of which the stepper motor 146 is a component to move to a desired configuration or position. The controller 144 will provide pulses at a rate that will cause the throttle stop of which the stepper motor 146 is a component to actuate at a desired rate. The controller 144 thereby controls both the configuration of the throttle stop of which the stepper motor 146 is a component and the rate at which it changes from one configuration to another.

The controller 144 of the control system 140 also controls a transbrake solenoid 152 of a racing vehicle through a line 154 in a conventional manner. A switch 156 is mounted to a line 158 that connects to the controller 144. The controller 144 is programmed to respond to the activation of the switch 156 by releasing the transbrake. The controller 144 then controls the stepper motor 146 as programmed to provide desired horsepower at programmed times after the switch 156 is activated and/or after the transbrake is released.

Figure 10:
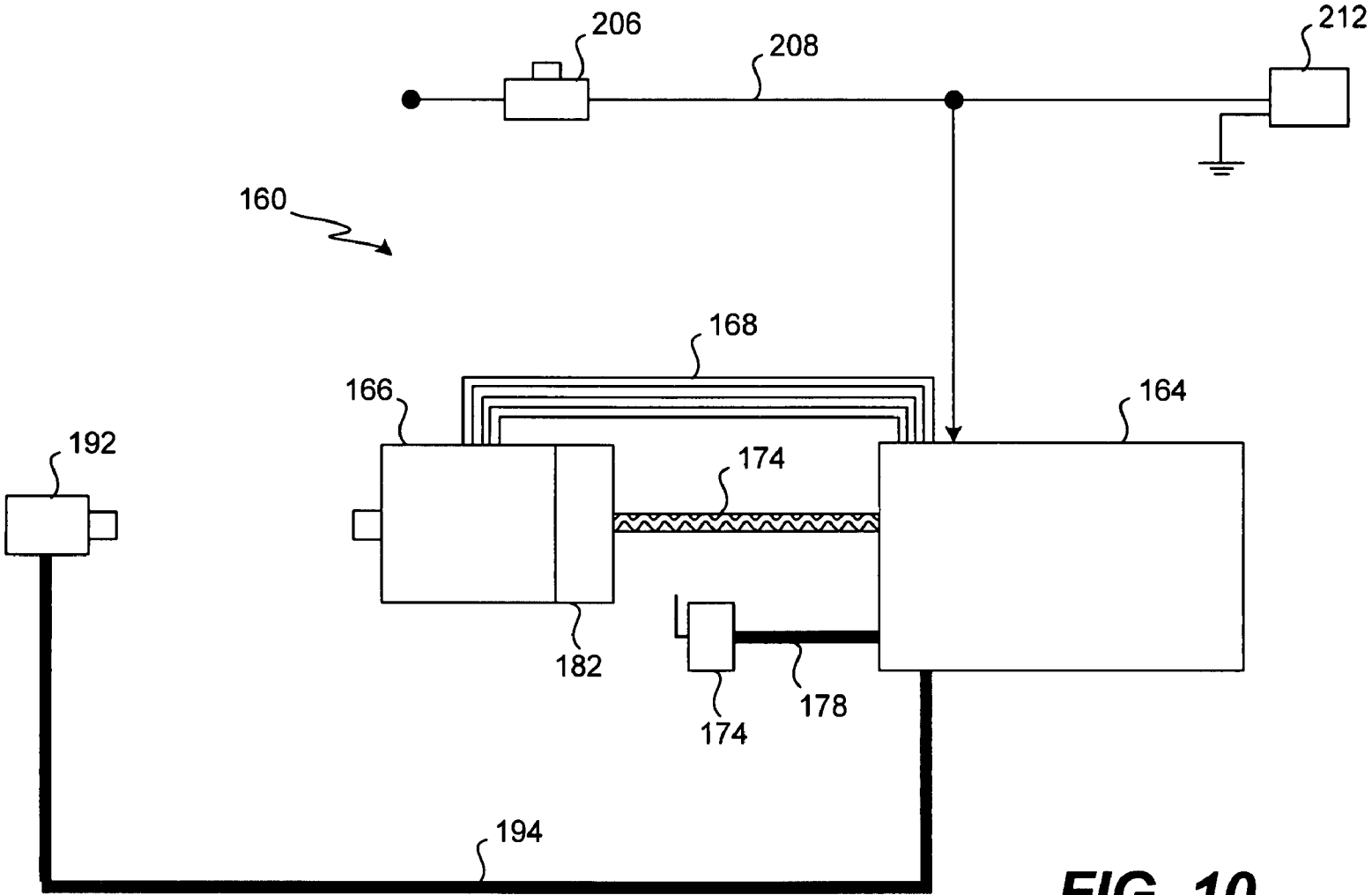
FIG. 10 is a schematic diagram of a control system for a throttle stop actuator according to the present invention having feedback connections to the throttle stop.

FIG. 10 shows a control system 160 for a throttle stop or throttle stop actuator according to the present invention. The control system includes a controller 164 connected to a stepper motor 166 that is a component of a throttle stop according to the present invention. A line 168 provides signals and power to the stepper motor 166 to cause the stepper motor 166 to rotate a characteristic amount or step. The controller 164 provides a number of pulses to the stepper motor 166 to cause the stepper motor to rotate an amount that will cause the throttle stop of which the stepper motor 166 is a component to move to a desired configuration or position. The controller 164 will provide pulses at a rate that will cause the throttle stop of which the stepper motor 166 is a component to actuate at a desired rate. The controller 164 thereby controls both the configuration of the throttle stop of which the stepper motor 166 is a component and the rate at which it changes from one configuration to another.

The control system 160 also includes a position sensing switch 174. As described above with reference to the switch 74, the positioning switch 174 is positioned to be contacted by a member of a throttle actuator that moves to indicate the configuration of the throttle stop. The switch 174 thereby provides an indication to the controller 164 that the throttle stop is at a specified configuration.

The control system 160 also includes a line 178 that provides stepper motor position information to the controller 164. As described above with reference to an encoder 82, an encoder 182 monitors movement of the stepper motor 166 and provides an indication of the position of the motor 166, and thereby the configuration of the throttle stop, to the controller 164.

The control system 160 may also include a linear position indicating device 192. As described above with reference to the linear position indicating device 92, the linear position indicating device 192 may be a linear potentiometer or LVDT that engages a member of the throttle stop actuator or throttle stop to provide an indication of the position of the throttle stop.

The encoder 172 and the linear position indicating device 192 can provide continuous feedback measurements of the position of the throttle stop enabling the controller 164 to assure that a desired configuration is actually achieved.

The control system 160 receives a trigger input on a line 208 when a switch 206 is closed. The switch 206 controls a solenoid 212 that controls a device, conventionally a "line lock" or transbrake, that prevents a car from moving from a starting line. As an alternative to the controller 144 that controls the transbrake, the controller 164 only responds to control a throttle stop as programmed when it receives a trigger signal from line 208.

As discussed, positioning of the throttle stop can be accomplished by using an electronic control module. The simplest form of module is an electronic pulser that is started by a trigger input. The pulse rate determines how fast the throttle stop is moved. A more advanced version has an adjustable variable pulse rate so that the rate of change can be varied.

An even more advanced controller is a microprocessor control module that is programmable. Movement times, rates of actuator change, and direction (open, close) are programmed individually. A preprogrammed operational curve that includes any throttle stop or throttle stop actuator position at any time can be generated.

Another controller is one as described above, but further includes feedback to the controller. This allows for monitoring a variety of data, such as engine rpms, weather conditions, engine exhaust temperatures, intake manifold boost pressures, or engine loads. Adjustments can then be made to the throttle stop to compensate for operating conditions.

The system of the present invention can be pre-programmed to operate a throttle stop based only on reaching a desired position, when the desired position is reached, and how fast the throttle stop moves to the desired position (rate). As an example, at a starting line, the throttle stop may initially be at a nearly wide-open position. Then, shortly after a race car leaves the starting line, the throttle stop may be closed at a fairly rapid rate to a nearly closed position. This position could be maintained, and then gradually the throttle stop could be opened up until almost a wide-open position is again reached. The throttle stop could then be held at that position. At some point near the end of the race, the throttle stop could be quickly moved to the wide-open position to provide a quick burst of power. Such a momentary snap opening may even be a manual override of a pre-programmed stop position As such, the system of the present invention may be operated to pre-set the throttle stop position, for example, prior to a race. That is, the throttle stop's rate of movement, position, and time of position may be set or programmed prior to the race. The system of the present invention does not require information regarding an engine's is performance. Rather, the position of the throttle stop is predetermined, and the engine performs as it will.

The present invention has been described by reference to specific embodiments of the invention. It will be appreciated by those skilled in the art that the invention may be practiced other than as described. For example, and without limitation, constructions and configurations of the throttle stops or throttle stop actuators other than those of the embodiments described herein may be used within the scope of the invention and control of the throttle stop or throttle stop actuators may be provided other than as described.

Additionally, for instance, a conventional electric motor can be used in place of a stepper motor. A feedback system would be used to insure accurate positioning of the throttle stop. A variety of feedback systems may be employed such as, as discussed above, an encoder, a linear potentiometer, or an LVDT.

Therefore, the invention not be limited to the particular embodiments disclosed. What is sought to be protected is all embodiments falling within the scope of the appended claims.

What is claimed is:

1. A throttle stop apparatus to regulate the power of an internal combustion engine comprising:

a body mounted in a flow path between an air-fuel metering device and intake valves of the engine;

at least a first plate and a second plate located within the body and moveable between a full open position and at least one flow restricting position to selectively regulate the power of the engine by controlling flow from the air-fuel metering device to the intake valves of the engine, each of the first and second plates having an opening with a configuration and dimension sufficient to create substantially no restriction to the flow in the full open position;

an electric motor driven actuator coupled to the first and second plates to move at least one plate relative to another to provide full alignment of the openings in the full open position at wide open throttle conditions of the engine and to provide at least partial restriction to the flow at the at least one flow restricting position; and a controller configured to control operation of the actuator and preprogrammable to include an operational curve that provides different positions, different rates of movement, different directions of movement, and different durations of movement for the first and second plates during the course of a race.

2. A throttle stop comprising:

a throttle stop element configured and arranged to be moveable between a full open position and at least one flow restricting position to regulate the power of an engine by controlling the flow from an air-fuel metering device to the engine;

an electric motor mounted to the throttle stop element, the motor configured to move the throttle stop element a characteristic amount upon receiving an electrical signal in a direction that is determined by the electrical signal such that the throttle stop element is moveable between the full open position and the at least one flow restricting position; and a controller configured to control operation of the motor and preprogrammed to provide different positions, different rates of movement, different directions of movement, and different durations of movement for the throttle stop element during the course of a race.

3. The throttle stop of claim 2 further including a feedback mechanism configured to determine a position of the throttle stop element.

4. The throttle stop of claim 3 wherein the feedback mechanism is an encoder, a linear potentiometer, or a linear variable displacement transducer.

5. The throttle stop of claim 2 wherein the electric motor is a stepper motor.

6. The throttle stop of claim 2 further including an open switch configured to provide an indication that the throttle stop element is at the full open position.

7. The throttle stop of claim 2 wherein the throttle stop element is a throttle linkage member, a set of butterflies, or counter rotating discs.

8. A controllable throttle stop comprising:

a mounting section constructed to engage a throttle linkage element;

an electric motor mounted to the mounting section, the motor being configured to move upon receiving an electrical signal in a direction that is determined by the electrical signal;

an extendable link extending away from the motor;

the motor coupled to the extendable link to move the extendable link away from the mounting section in one direction and to move the extendable link toward the mounting section in another direction whereby the motor lengthens and shortens the throttle stop; and a controller configured to control operation of the motor and programmable to provide different positions, different rates of movement, different directions of movement, and different durations of movement for the extendable link during the course of a race.

9. The controllable throttle stop of claim 8 wherein the electric motor is a stepper motor, the stepper motor being configured to rotate in two opposite rotational directions and to rotate a characteristic amount upon receiving an electrical pulse, the stepper motor configured to move the extendable link away from the mounting section upon rotation of the stepper motor in one rotational direction and to move the extendable link toward the mounting section upon rotation of the stepper motor in the other rotational direction.

10. The controllable throttle stop of claim 9 wherein the extendable link is threaded at an end and the stepper motor further includes a collar that engages the threaded end to move along the threaded end as the collar is rotated.

11. The controllable throttle stop of claim 9 wherein the controller is configured to provide electrical pulses to the stepper motor to cause the stepper motor to rotate and is programmable to cause the stepper motor to cause the extendable link to move a selected distance.

12. The controllable throttle stop of claim 11 wherein the controller is programmable to provide pulses to the stepper motor at a selected rate to specify the length of time during which the extendable link moves.

13. The controllable throttle stop of claim 8 further including a feedback mechanism configured to determine the position of the extendable link.

14. A controllable throttle stop comprising:

a baseplate constructed to be mounted between a fuel metering device and an intake manifold of an internal combustion engine, the baseplate having passages through which air and fuel flow from the fuel metering device into the internal combustion engine;

throttle plates movably mounted to the baseplate to selectively interfere with flow through the passages;

a throttle plate mechanism configured to engage the throttle plates to selectively move the throttle plates between a closed position that interferes with flow through the passages and an open position that permits at least substantially unimpeded flow through the passages;

an electrical motor driven actuator operatively coupled to the throttle plate mechanism to move the throttle plates to a more open position in one direction and to a more closed position in another direction to thereby selectively position the throttle plates; and a controller configured to control operation of the actuator and programmable to include an operational curve that provides different positions, different rates of movement, different directions of movement, and different durations of movement for the throttle plates during the course of a race.

15. The throttle stop of claim 14 wherein the actuator is a stepper motor coupled to the throttle plate mechanism, the stepper motor being configured to rotate in two opposite rotational directions and to rotate a characteristic amount upon receiving an electrical pulse, and the stepper motor being coupled to the throttle plate mechanism to move the throttle plates to a more open position upon rotation of the stepper motor in one rotational direction and to move the throttle plates to a more closed position upon rotation of the stepper motor in the other rotational direction.

16. The throttle stop of claim 15 wherein the controller is configured to provide electrical pulses to the stepper motor to cause the stepper motor to rotate to move the throttle plates a selected amount.

17. A throttle stop of claim 14 wherein the throttle plates are butterflies mounted in the passages.

18. A throttle stop of claim 14 wherein the throttle plates are counter rotating discs mounted in the passages.

19. The throttle stop of claim 14 further including a feedback mechanism configured to determine the position of the throttle plates.

* * * * *